US009698490B2

(12) United States Patent
Wright et al.

(10) Patent No.: US 9,698,490 B2
(45) Date of Patent: Jul. 4, 2017

(54) INJECTION MOLDABLE CONE RADIATOR SUB-REFLECTOR ASSEMBLY

(71) Applicant: CommScope Technologies LLC, Hickory, NC (US)

(72) Inventors: Alastair Wright, Edinburgh (GB); John Curran, Kirkcaldy (GB)

(73) Assignee: CommScope Technologies LLC, Hickory, NC (US)

( * ) Notice: Subject to any disclaimer, the term of this patent is extended or adjusted under 35 U.S.C. 154(b) by 347 days.

(21) Appl. No.: 13/795,274

(22) Filed: Mar. 12, 2013

(65) Prior Publication Data

US 2013/0271349 A1 Oct. 17, 2013

Related U.S. Application Data

(63) Continuation-in-part of application No. 13/448,995, filed on Apr. 17, 2012, now Pat. No. 9,105,981.

(51) Int. Cl.
*H01Q 15/14* (2006.01)
*H01Q 19/19* (2006.01)

(52) U.S. Cl.
CPC ..... *H01Q 15/14* (2013.01); *H01Q 19/193* (2013.01)

(58) Field of Classification Search
CPC ..... H01Q 15/14; H01Q 19/193
USPC ..... 343/912
See application file for complete search history.

(56) References Cited

U.S. PATENT DOCUMENTS 2,605,416 A 7/1952 Foster
4,295,142 A * 10/1981 Thiere ..... H01Q 13/0208 343/781 CA
4,673,945 A 6/1987 Syrigos
4,673,947 A 6/1987 Newham
4,963,878 A 10/1990 Kildal
5,959,590 A 9/1999 Sanford et al.
5,973,652 A 10/1999 Sanford et al.
6,020,859 A * 2/2000 Kildal ..... H01Q 1/42 343/781 CA (Continued)

FOREIGN PATENT DOCUMENTS

EP 0439800 8/1991
WO WO 2011073844 6/2011

OTHER PUBLICATIONS

Kang Sung Chul, International Search Report for Corresponding PCT application PCT/US13/36689, Sep. 23, 2013, Daejeon Metropolitan City, Korea.

(Continued)

*Primary Examiner* — Dameon E Levi
*Assistant Examiner* — Walter Davis
(74) *Attorney, Agent, or Firm* — Myers Bigel, P.A.

(57) ABSTRACT

A dielectric cone radiator sub-reflector assembly for a reflector antenna with a waveguide supported sub-reflector is provided as a unitary dielectric block with a sub-reflector at a distal end. A waveguide transition portion of the dielectric block is dimensioned for insertion coupling into an end of the waveguide. A sub-reflector support portion of the dielectric block and the waveguide transition portion provided with a plurality of longitudinal ribs and grooves coaxial with a longitudinal axis of the assembly; the longitudinal grooves open to a proximal end of the dielectric block. The unitary dielectric block may be manufactured as a single contiguous monolithic portion of dielectric material via injection molding.

17 Claims, 9 Drawing Sheets

(56) References Cited

U.S. PATENT DOCUMENTS

| | | | | |
|---|---|---|---|---|
| 6,107,973 | A | 8/2000 | Knop et al. | |
| 6,137,449 | A | 10/2000 | Kildal | |
| 6,429,826 | B2 | 8/2002 | Karlsson et al. | |
| 6,456,253 | B1 | 9/2002 | Rummeli et al. | |
| 6,522,305 | B2 | 2/2003 | Sharman | |
| 6,697,027 | B2 | 2/2004 | Mahon | |
| 6,724,349 | B1 | 4/2004 | Baird et al. | |
| 6,831,612 | B2 | 12/2004 | King et al. | |
| 6,862,000 | B2 | 3/2005 | Desargant et al. | |
| 6,919,855 | B2 | 7/2005 | Hills | |
| 6,985,120 | B2 | 1/2006 | Lewry et al. | |
| 6,995,727 | B2 * | 2/2006 | Tuau | H01Q 19/193 343/781 CA |
| 7,023,394 | B2 * | 4/2006 | Mahr | H01Q 1/42 343/781 CA |
| 7,602,347 | B2 | 10/2009 | Flynn et al. | |
| 7,907,097 | B2 * | 3/2011 | Syed | H01Q 1/24 343/781 CA |
| 8,581,795 | B2 * | 11/2013 | Simms | H01Q 1/42 343/781 CA |
| 2005/0007288 | A1 | 1/2005 | Tuau | |
| 2005/0017916 | A1 | 1/2005 | Lewry | |
| 2005/0062663 | A1 | 3/2005 | Hills | |
| 2009/0021442 | A1 | 1/2009 | Syed et al. | |

OTHER PUBLICATIONS

Extended European Search Report for European Patent Application No. 13778154.8, completed Oct. 23, 2015, 7 pages.

Yang J. et al, "FDTD design of a Chinese hat feed for shallow mm-wave reflector antennas", *Antennas and Propagation Society International Symposium*, Jun. 21, 1998, 4 pages.

* cited by examiner

INJECTION MOLDABLE CONE RADIATOR SUB-REFLECTOR ASSEMBLY

BACKGROUND

Field of the Invention

This invention relates to a microwave dual reflector antenna. More particularly, the invention provides a self supported feed cone radiator for such antennas suitable for cost efficient manufacture via injection molding.

Description of Related Art

Dual reflector antennas employing self-supported feed direct a signal incident on the main reflector onto a sub-reflector mounted adjacent to the focal region of the main reflector, which in turn directs the signal into a waveguide transmission line typically via a feed horn or aperture to the first stage of a receiver. When the dual reflector antenna is used to transmit a signal, the signals travel from the last stage of the transmitter system, via the waveguide, to the feed aperture, sub-reflector, and main reflector to free space.

The electrical performance of a reflector antenna is typically characterized by its gain, radiation pattern, cross-polarization and return loss performance—efficient gain, radiation pattern and cross-polarization characteristics are essential for efficient microwave link planning and coordination, whilst a good return loss is necessary for efficient radio operation.

These principal characteristics are determined by a feed system designed in conjunction with the main reflector profile.

Commonly owned U.S. Pat. No. 6,107,973, titled "Dual-Reflector Microwave Antenna" issued Aug. 22, 2000 demonstrates a feed assembly wherein a sub-reflector is supported by a dielectric funnel coupled to the end of a supporting waveguide. Functioning as a support structure only, the dielectric funnel becomes an impedance discontinuity that must be compensated for as the sub-reflector and reflector dish surface profiles and diameters, alone, are utilized to shape the RF path, resulting in an increased diameter of the sub-reflector and/or reflector dish. As the sub-reflector dimensions increase, RF signal path blockage by the sub-reflector along the boresight of the reflector antenna becomes significant. Further, an increased overall dimension of the resulting reflector antenna requires additional reinforcing structure considerations for both the reflector antenna and support structures the reflector antenna may be mounted upon.

Deep dish reflectors are reflector dishes wherein the ratio of the reflector focal length (F) to reflector diameter (D) is made less than or equal to 0.25 (as opposed to an F/D of 0.35 typically found in more conventional dish designs). An example of a dielectric cone feed sub-reflector assembly configured for use with a deep dish reflector is disclosed in commonly owned U.S. Pat. No. 6,919,855, titled "Tuned Perturbation Cone Feed for Reflector Antenna" issued Jul. 19, 2005 to Hills, hereby incorporated by reference in its entirety. U.S. Pat. No. 6,919,855 utilizes a dielectric block cone feed with a sub-reflector surface and a leading cone surface having a plurality of downward angled non-periodic perturbations concentric about a longitudinal axis of the dielectric block. However, the plurality of angled features and/or steps in the dielectric block requires complex machine tool manufacturing procedures which may increase the overall manufacturing cost.

Therefore it is the object of the invention to provide an apparatus that overcomes limitations in the prior art, and in so doing presents a solution that allows such a feed design to provide reflector antenna characteristics which meet the most stringent electrical specifications over the entire operating band used for a typical microwave communication link.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1:
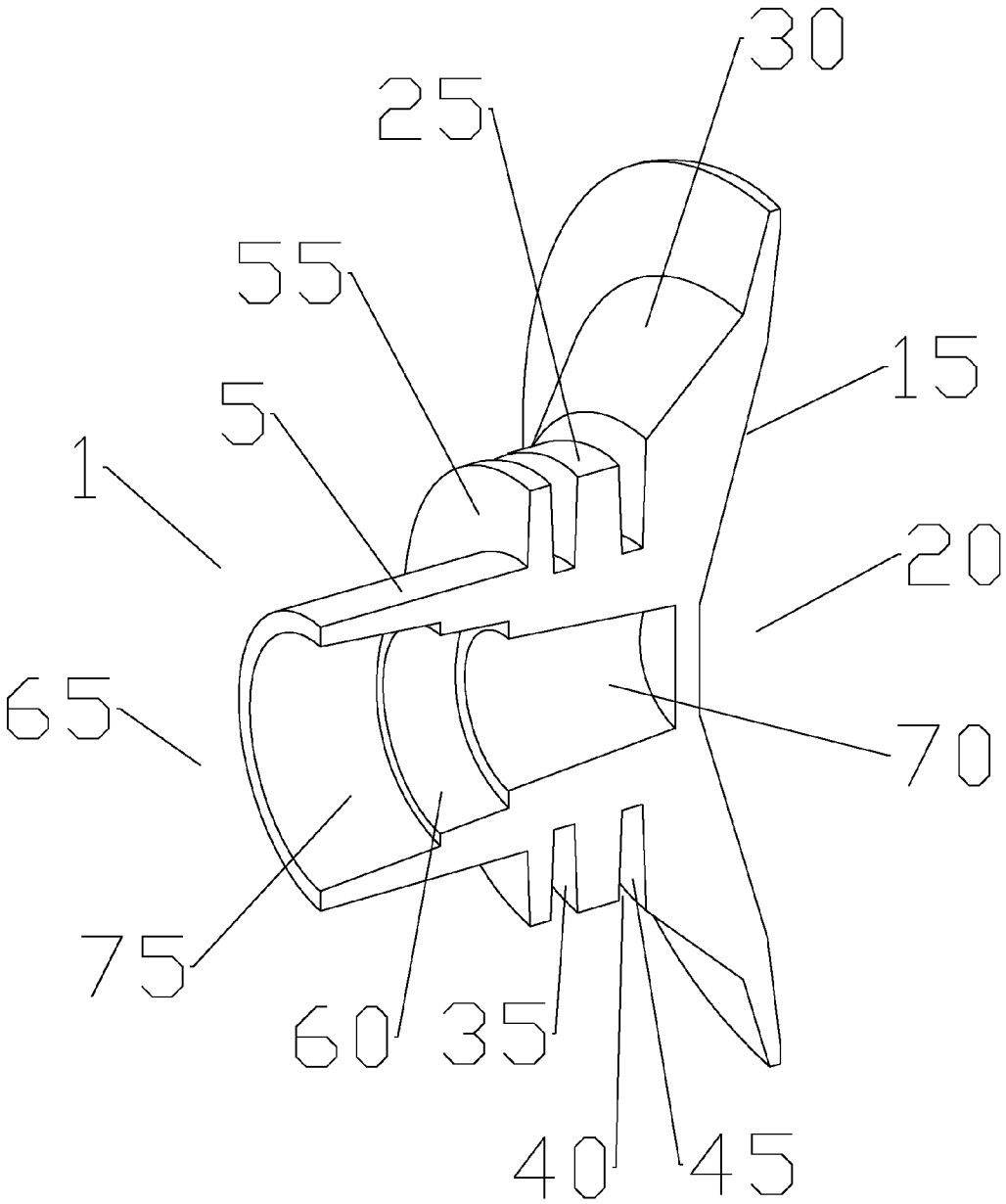
FIG. 1 is a schematic cross-section cut-away side isometric view of an exemplary injection moldable dielectric cone radiator assembly.
Figure 2:
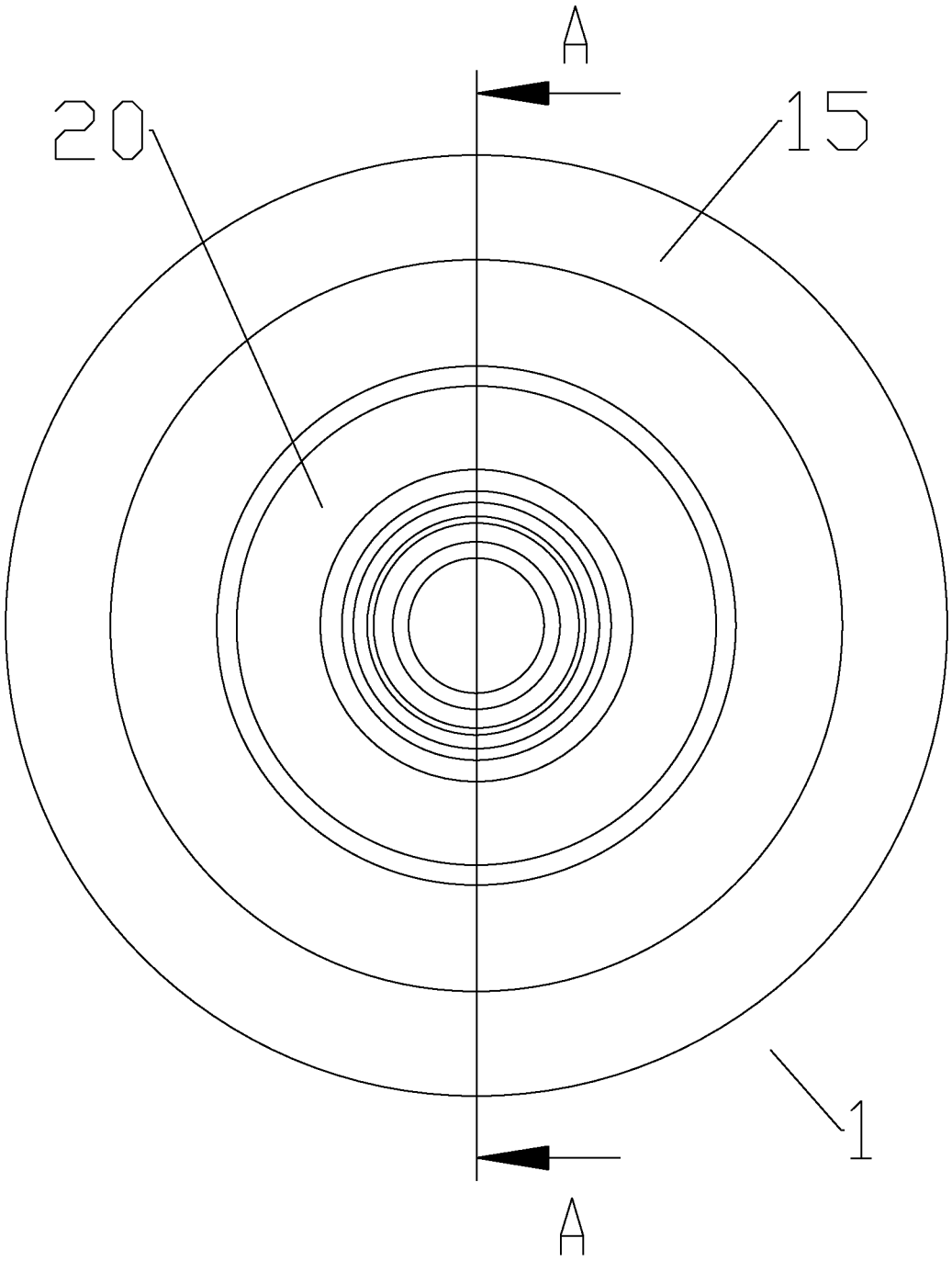
FIG. 2 is a schematic front view of the injection moldable dielectric cone radiator assembly of FIG. 1.

The inventors have recognized that improvements in cone radiator sub-reflector assembly designs utilizing unitary dielectric blocks typically require manufacture of the dielectric block by machining, due to the increased size and complexity of these designs.

When injection molding and/or casting methods of manufacture are attempted on the prior dielectric block type cone radiator sub-reflector assembly designs, the increased size may create issues with the setting of the dielectric polymer material, such as voids, cracks, surface sink, dimensional bends and/or sagging. Further, where the designs utilize features that inhibit mold separation, such as overhanging and/or close proximity opposing edges, the required mold, if possible at all, may become too complex to be cost effective.

As shown in FIGS. 1-6, a cone radiator sub-reflector assembly 1 may be configured to couple with the end of a feed boom waveguide at a waveguide transition portion 5 of a unitary dielectric block 10 which supports a sub-reflector 15 at the distal end 20. The sub-reflector 15 and a supporting subreflector support portion 30 are provided with an enlarged diameter for reduction of sub-reflector spill-over.

A dielectric radiator portion 25 is situated between the waveguide transition portion 5 and the sub-reflector support portion 30. A plurality of corrugations are provided along the outer diameter of the dielectric radiator portion as radial grooves 35. In the present embodiments, the plurality of grooves is two radial grooves 35. A distal groove 40 of the dielectric radiator portion 25 may be provided with a distal sidewall 45 that initiates the sub-reflector support portion 30. To enable smooth mold separation, the grooves 40 may be provided with a taper that increases the groove width towards the outer diameter of the dielectric radiator portion 25.

The waveguide transition portion 5 of the sub-reflector assembly 1 may be adapted to match a desired circular waveguide internal diameter so that the sub-reflector assembly 1 may be fitted into and retained by the waveguide end that supports the sub-reflector assembly 1 within the dish reflector of the reflector antenna proximate a focal point of the dish reflector. The waveguide transition portion 5 may insert into the waveguide 3 until the end of the waveguide abuts a shoulder 55 of the waveguide transition portion 5.

The shoulder 55 may be dimensioned to space the dielectric radiator portion 25 away from the waveguide end.

One or more step(s) 60 at the proximal end 65 of the waveguide transition portion 5 may be applied to a lens bore 70 of the dielectric block 10 to form an inverted impedance transformer 75 for impedance matching purposes between the waveguide and the dielectric material of the dielectric block 10.

The lens bore 70 extends from the proximal end 65 of the dielectric block 10 towards the distal end 20 of the dielectric block 10 at least to the sub-reflector support portion 30. Thereby, a direct path between the waveguide 3 and the dielectric radiator portion 25 is formed, enabling tuning of the radiation pattern emitted therethrough, for example, via the depth applied to the radial grooves 35 and/or diameter of the dielectric radiator portion 25. Preferably, as best shown in FIGS. 3 and 6, the radial grooves 35 extend radially inward to a diameter less than an inner diameter of the end of the waveguide.

One skilled in the art will appreciate that the dielectric radiator portion 25, in combination with the lens bore 70 therethrough, creates a dielectric lens effect in which the dimensions of the dielectric radiator portion 25 enhances a primary radiation pattern projected through the dielectric radiator portion 25 to/from the sub-reflector 15 from/to the reflector dish that the sub reflector assembly 1 is mounted within, thereby assisting the shaping of the RF radiation pattern of the sub-reflector assembly 1 and reducing the diameter of sub-reflector 15.

Figure 4:
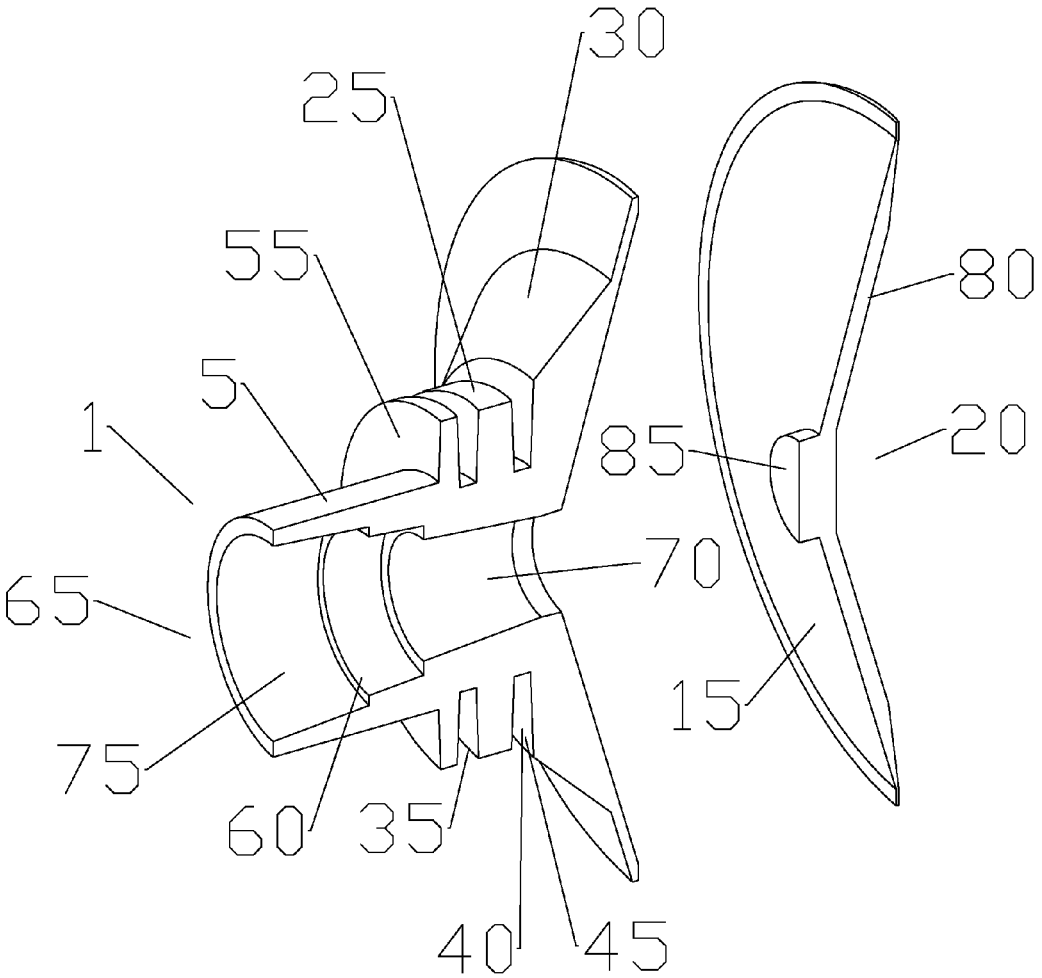
FIG. 4 is a schematic cross-section cut-away side isometric view of an alternative exemplary injection moldable dielectric cone radiator assembly, with a separate sub-reflector disc.
Figure 5:
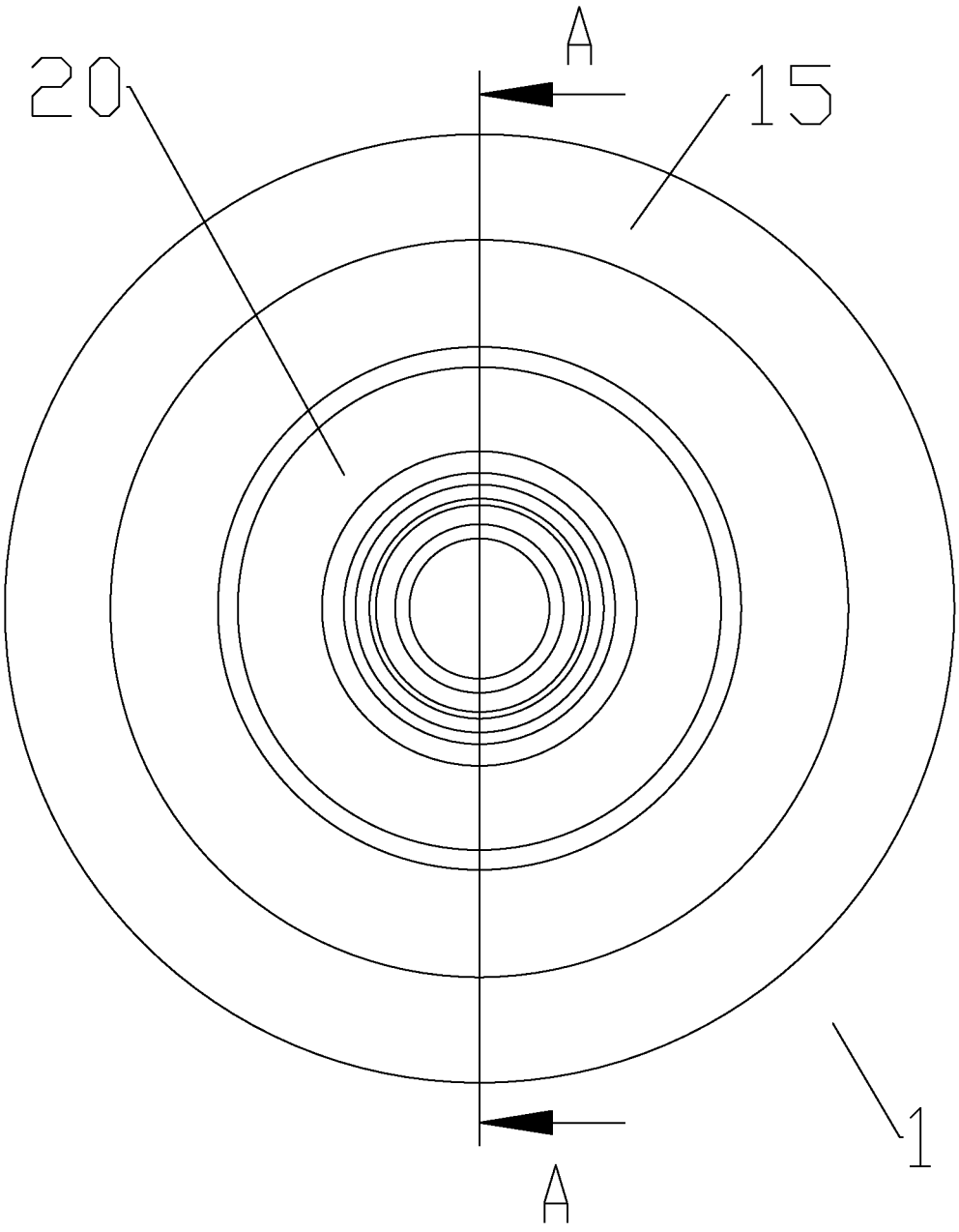
FIG. 5 is a schematic front view of the injection moldable dielectric cone radiator assembly of FIG. 4.
Figure 6:
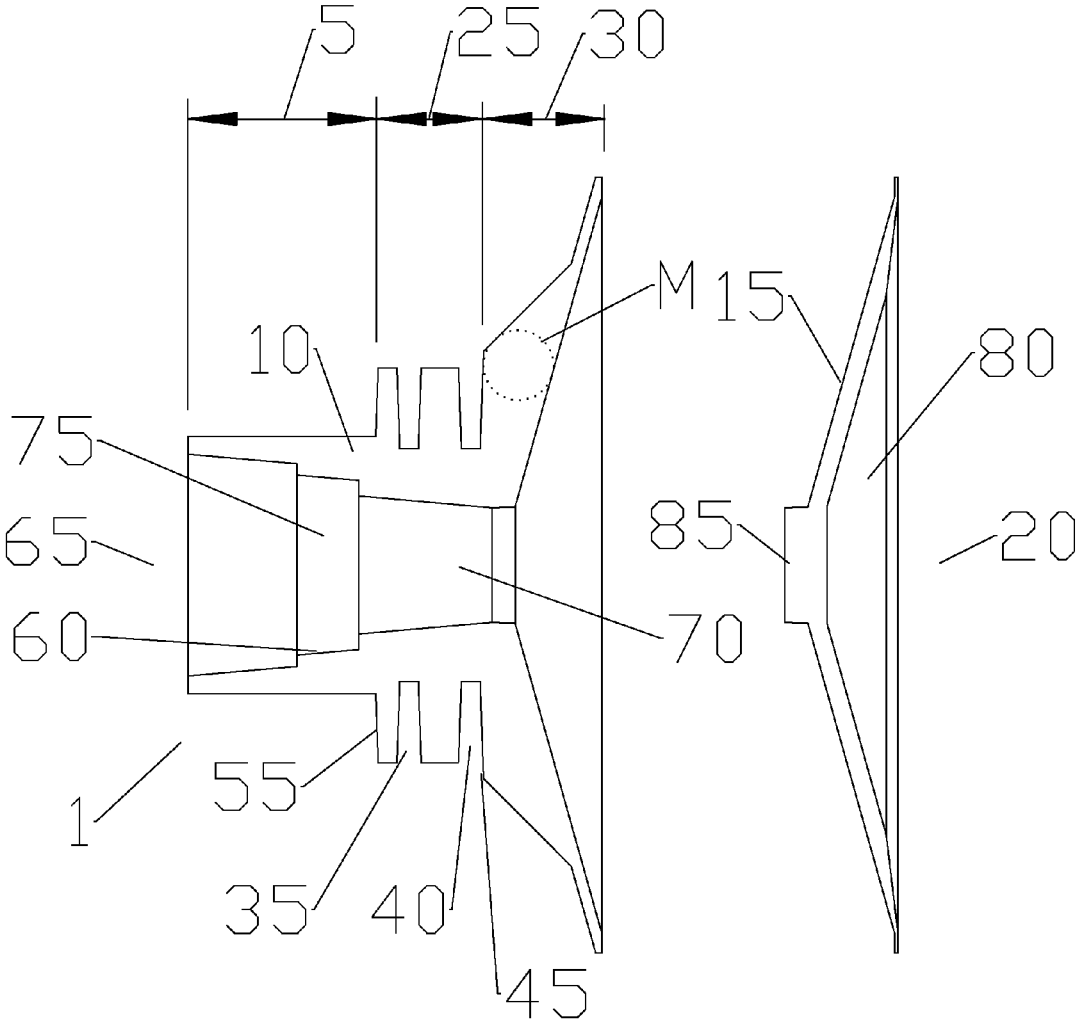
FIG. 6 is a schematic cut-away side view of the injection moldable dielectric cone radiator assembly of FIG. 4, taken along line A-A of FIG. 5.

As shown in FIGS. 4-6, the lens bore 70 may be provided extending entirely through the dielectric block 10, between the proximal end 65 and the distal end 20.

Figure 3:
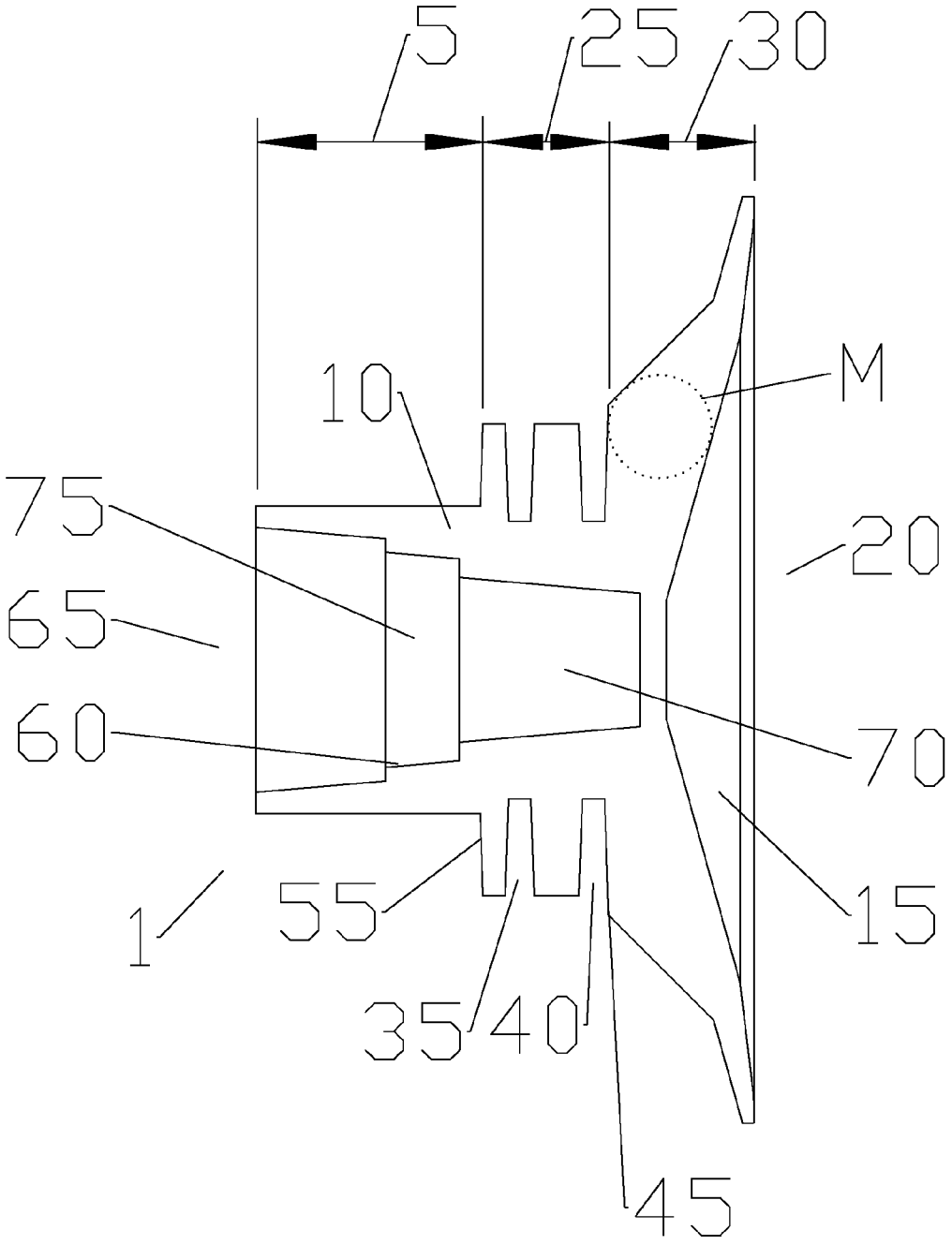
FIG. 3 is a schematic cut-away side view of the injection moldable dielectric cone radiator assembly of FIG. 1, taken along line A-A of FIG. 2.

As best shown in FIG. 3, sub-reflector 15 may be formed by applying a metallic deposition, film, sheet or other RF reflective coating to the distal end 20 of the dielectric block 10. Alternatively, as shown in FIGS. 4 and 6, the sub-reflector 15 may be formed separately, for example as a metal disk 80 which seats upon the distal end of the dielectric block 10. The disk 80 may include a key portion 85 that keys with the lens bore 70 to position the sub-reflector 15 coaxially upon the distal end 20 of the dielectric block 10.

Demonstrated as the largest diameter inscribed circle M possible within the confines of a cross-section of the dielectric block 10, the centerpoint of such a circle is generally the point from which it is farthest to an edge of the dielectric block 10, the maximum material thickness. Thus, the centerpoint is the location where during injection molding of the dielectric block 10, the dielectric material will typically solidify/set last. The maximum material thickness occurs in the embodiments of FIGS. 3 and 6 located between the distal sidewall 45 and the distal end 20. In contrast, the maximum material thickness of prior embodiments of monolithic dielectric block cones is much larger, typically at least the entire inner diameter of the waveguide end. One skilled in the art will appreciate that the combination of the lens bore 70 and the deepened radial grooves 35 may significantly reduce the maximum material thickness of the dielectric block 10, enabling the manufacture of the dielectric block 10 via injection molding with reduced voids, cracks, surface sink, dimensional bends and/or sagging defects. Alternatively, the dielectric block 10 may be manufactured by casting and/or machining, which methods may similarly benefit from the common angle of mold/tool separation/approach, shallower edge angles and/or number of surface transitions required.

Figure 7:
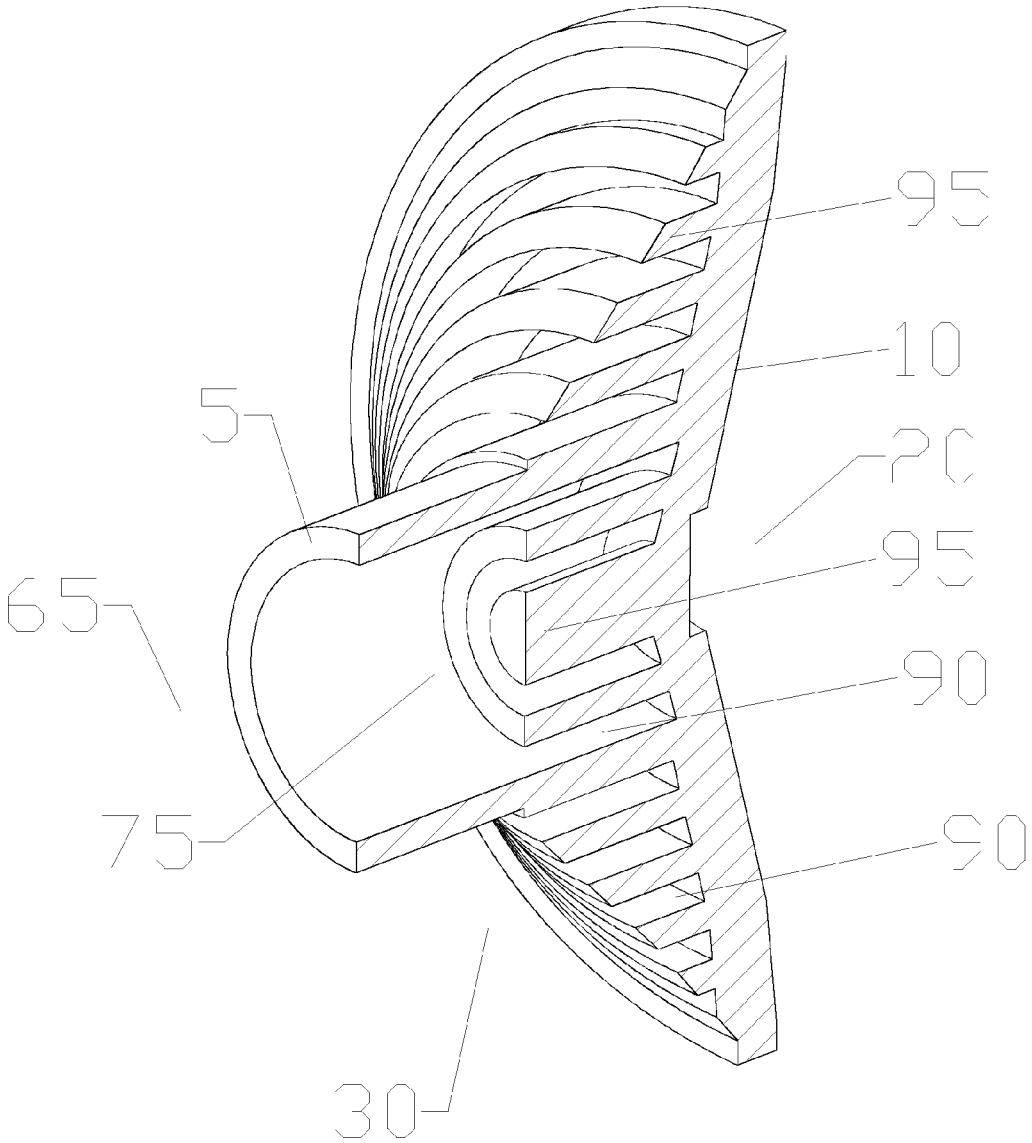
FIG. 7 is a schematic cross-section cut-away isometric view of an alternative dielectric block configuration.
Figure 8:
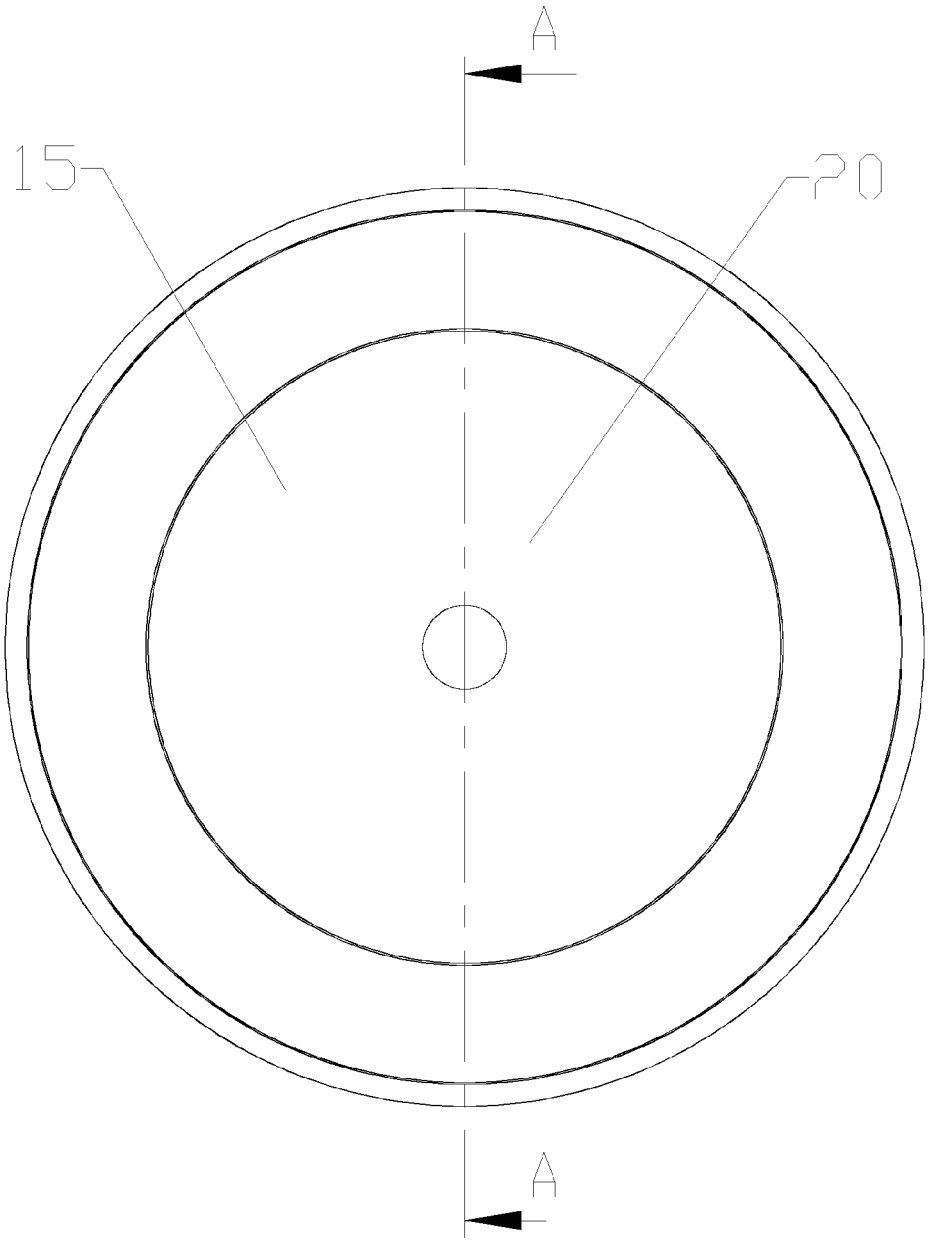
FIG. 8 is distal end view of the dielectric block of FIG. 7, with a sub-reflector coupled to the distal end.

One skilled in the art will appreciate that the dielectric block 10 may be alternatively formed with longitudinal grooves instead of radial grooves to further simplify manufacture by injection molding with reduced maximum material thickness. As shown for example in FIGS. 7 and 9, a plurality of longitudinal grooves 90 and longitudinal ribs 95 therebetween may be applied coaxial with a longitudinal axis of the dielectric block 10. In view of the segmentation of the dielectric block 10 by longitudinal grooves 90 instead of radial grooves, the waveguide transition portion 5 and sub-reflector support portion 30 are characterized as inner and outer coaxial portions, respectively, an outer diameter of the waveguide transition portion 5 dimensioned to seat, for example, within the inner diameter of the waveguide for coupling therewith and portions between these surfaces and a periphery of the dielectric block 10 are operative as the sub-reflector support portion 30.

The longitudinal grooves 90 are each open to the proximal end 65 of the dielectric block 10. Thus, during injection molding of the dielectric block 10, mold separation, where there are no overhanging features present between the longitudinal grooves 90 and the proximal end 65, may be along the longitudinal axis of the dielectric block 10, enabling a two part mold and localizing any mold flash that may occur to the periphery of the dielectric block 10, instead of a potentially difficult to remove longitudinal flash along each of the grooves that may be present in the dielectric block 10 of the radial groove embodiments of FIGS. 3 and 6. The longitudinal grooves 90 may be provided with a taper for ease of mold separation.

A longitudinal extent of the longitudinal rib(s) 95 and/or longitudinal groove(s) 90 of the wave guide transition portion 5 may be selected to provide an impedance transformer 75 for impedance matching purposes between the waveguide and the dielectric material of the dielectric block 10.

A longitudinal extent of the longitudinal rib(s) 95 of the sub-reflector support portion 30 toward the proximal end 65 of the dielectric block 10 shortens between an inner diameter and a periphery of the sub-reflector support portion 30. Further, a leading edge of the longitudinal ribs of the sub-reflector support portion may be angled to form a generally conical surface with a maximum diameter toward the distal end 20, the plurality of longitudinal ribs 95 together forming a generally conical surface profile for the sub-reflector support portion. Alternatively, the longitudinal ribs 95 may be dimensioned to create alternative surface profiles as desired for electrical performance including, for example, a staggered or planar surface profile.

Figure 9:
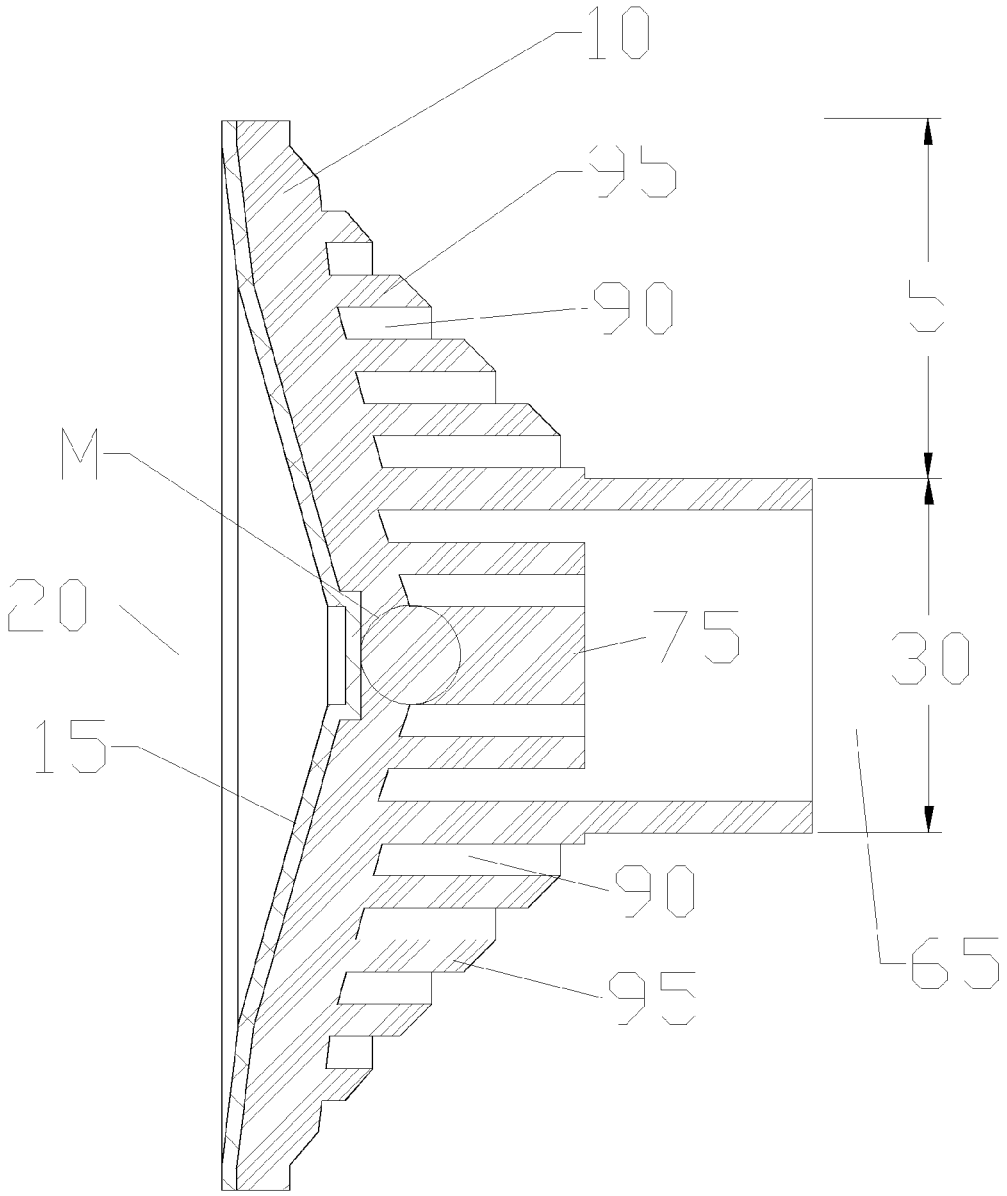
FIG. 9 is a schematic side cut-away close-up view of the dielectric block and sub-reflector of FIG. 8, taken along line A-A of FIG. 8.

As shown in FIG. 9, a depth of the longitudinal grooves 90 may be selected to obtain a balance between electrical performance, necessary strength and maximum material thickness, for example where the maximum material thickness M of the dielectric block 10 occurs between a distal end 20 of a pair of the longitudinal grooves 90 and the sub-reflector 15.

As with the radial groove embodiments, in the longitudinal groove embodiment the sub-reflector 15 may be provided as a metal coating upon the distal end 20 of the dielectric block 10 or as a separate metallic disc coupled to the distal end 20 of the dielectric block 10. The longitudinal axis mold separation further enables the sub-reflector 15 to be fitted within the dielectric block mold and coupled there to by the injection molding.

From the foregoing, it will be apparent that the present invention brings to the art a sub-reflector assembly 1 for a reflector antenna with the potential for significant manufacturing cost efficiencies. The sub-reflector assembly 1 according to the invention are strong, lightweight and may be repeatedly cost efficiently manufactured with a very high level of precision via, for example, injection molding technology.

Table of Parts

| | |
|---|---|
| 1 | sub-reflector assembly |
| 5 | waveguide transition portion |
| 10 | dielectric block |
| 15 | sub-reflector |
| 20 | distal end |
| 25 | dielectric radiator portion |
| 30 | sub-reflector support portion |
| 35 | radial groove |
| 40 | distal groove |
| 45 | distal sidewall |
| 55 | shoulder |
| 60 | step |
| 65 | proximal end |
| 70 | lens bore |
| 75 | impedance transformer |
| 80 | disk |
| 85 | key portion |
| 90 | longitudinal groove |
| 95 | longitudinal rib |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A cone radiator sub-reflector assembly for a reflector antenna with a sub-reflector supported by a waveguide, comprising:

a unitary dielectric block;

a sub-reflector provided at a distal end of the unitary dielectric block;

a waveguide transition portion of the unitary dielectric block dimensioned to seat inside an end of the waveguide; and a sub-reflector support portion of the unitary dielectric block supporting the sub-reflector, wherein the sub-reflector support portion and the waveguide transition portion each comprise at least one longitudinal rib and at least one longitudinal groove, wherein the at least one longitudinal rib and the at least one longitudinal groove of both the sub-reflector support portion and the waveguide transition portion are coaxial with a longitudinal axis of the unitary dielectric block, and wherein the at least one longitudinal groove of the sub-reflector support portion and the at least one longitudinal groove of the waveguide transition portion are open to a proximal end of the unitary dielectric block, and wherein a leading edge of each of the at least one longitudinal rib of the sub-reflector support portion is angled, forming a conical surface profile with a maximum diameter toward a distal end of the unitary dielectric block.

2. The cone radiator sub-reflector assembly of claim 1, wherein the at least one longitudinal rib of the waveguide transition portion comprises a plurality of longitudinal ribs dimensioned to provide an impedance transformer.

3. The cone radiator sub-reflector assembly of claim 1, wherein the at least one longitudinal rib of the sub-reflector support portion comprises a first longitudinal rib of the sub-reflector support portion located closer to a periphery of the sub-reflector support portion than a second longitudinal rib of the sub-reflector support portion, and wherein a longitudinal extent of the second longitudinal rib of the sub-reflector support portion is greater than a longitudinal extent of the first longitudinal rib of the sub-reflector support portion.

4. The cone radiator sub-reflector assembly of claim 1, wherein a maximum material thickness of the unitary dielectric block occurs between a distal end of a pair of the longitudinal grooves of the sub-reflector support portion and the sub-reflector.

5. The cone radiator sub-reflector assembly of claim 1, wherein the at least one longitudinal groove of the sub-reflector support portion and the at least one longitudinal groove of the waveguide transition portion are tapered.

6. The cone radiator sub-reflector assembly of claim 1, wherein the sub-reflector comprises a metal coating upon the distal end of the unitary dielectric block.

7. The cone radiator sub-reflector assembly of claim 1, wherein the sub-reflector comprises a separate metal disc coupled to the distal end of the unitary dielectric block.

8. A cone radiator sub-reflector assembly, comprising:

a unitary dielectric block;

a first portion of the unitary dielectric block dimensioned to seat inside an end of a waveguide; and a second portion of the unitary dielectric block dimensioned to support a sub-reflector;

wherein the second portion comprises a plurality of longitudinal ribs and a plurality of longitudinal grooves, wherein each longitudinal rib and longitudinal groove is coaxial with a longitudinal axis of the unitary dielectric block, and wherein each longitudinal rib of the plurality longitudinally extends from the second portion toward the first portion and comprises an angled edge, resulting in a plurality of angled edges forming a conical surface profile with a maximum diameter toward a distal end of the unitary dielectric block.

9. The cone radiator sub-reflector assembly of claim 8, wherein the first portion comprises a plurality of longitudinal ribs dimensioned to provide an impedance transformer.

10. The cone radiator sub-reflector assembly of claim 8, wherein a first longitudinal rib of the plurality of longitudinal ribs is located closer to a periphery of the second portion than a second longitudinal rib of the plurality of longitudinal ribs, and wherein a longitudinal extent of the second longitudinal rib is greater than a longitudinal extent of the first longitudinal rib.

11. The cone radiator sub-reflector assembly of claim 8, wherein a maximum material thickness of the unitary dielectric block occurs between a pair of the longitudinal grooves of the second portion and a sub-reflector attachment area of the second portion.

12. The cone radiator sub-reflector assembly of claim 8, wherein each longitudinal groove of the plurality of longitudinal grooves is tapered.

13. The cone radiator sub-reflector assembly of claim 8, further comprising a sub-reflector attached to the second portion, wherein the sub-reflector comprises a metal disc dimensioned for coupling with the second portion.

14. A cone radiator sub-reflector assembly, comprising:

a unitary dielectric block;

an inner portion of the unitary dielectric block dimensioned to seat inside an end of a waveguide; and an outer portion of the unitary dielectric block comprising a distal surface of the unitary dielectric block coated with a metal;

wherein the outer portion comprises a plurality of longitudinal ribs and a plurality of longitudinal grooves, wherein the plurality of longitudinal ribs and the plurality of longitudinal grooves are coaxial with a longitudinal axis of the unitary dielectric block, and wherein a leading edge of each longitudinal rib of the plurality of longitudinal ribs is angled, resulting in a plurality of leading edges forming a conical surface profile with a maximum diameter toward a distal end of the unitary dielectric block.

15. The cone radiator sub-reflector assembly of claim 14, wherein the inner portion comprises at least one longitudinal rib dimensioned to provide an impedance transformer.

16. The cone radiator sub-reflector assembly of claim 14, wherein the plurality of longitudinal ribs comprises a first longitudinal rib closer to a periphery of the outer portion than a second longitudinal rib of the plurality of longitudinal ribs, and wherein a longitudinal extent of the second longitudinal rib is greater than a longitudinal extent of the first longitudinal rib.

17. The cone radiator sub-reflector assembly of claim 14, wherein a maximum material thickness of the unitary dielectric block occurs between a distal end of a pair of the longitudinal grooves and the distal surface of the unitary dielectric block.

* * * * *